US005682960A

United States Patent [19]

Mobley et al.

[11] Patent Number: 5,682,960

[45] Date of Patent: Nov. 4, 1997

[54] LADDER JACKET

[76] Inventors: Michael M. Mobley; Sharee L. Mobley, both of 2412 SW. 10th St., Blue Springs, Mo. 64015

[21] Appl. No.: 733,610

[22] Filed: Oct. 18, 1996

[51] Int. Cl.[6] ..... B65D 65/00

[52] U.S. Cl. ..... 182/129; 150/154

[58] Field of Search ..... 182/129, 107; 150/154

[56] References Cited

U.S. PATENT DOCUMENTS 4,726,446 2/1988 Perbiy ..... 182/107 X
5,104,085 4/1992 Brice ..... 150/154 X

*Primary Examiner*—Alvin C. Chin-Shue
*Attorney, Agent, or Firm*—Brendan B. Dix

[57] ABSTRACT

A protective covering for a ladder consisting of two portions of a protective material on either side of an elastic portion of material. The protective covering is attached along the edges of the protective covering by cords or hook and loop fastening straps.

6 Claims, 1 Drawing Sheet

LADDER JACKET

BACKGROUND - FIELD OF INVENTION

1. Field of Invention

This invention relates to protective coverings, in particular to a covering for the protection of a ladder.

BACKGROUND - DESCRIPTION OF PRIOR ART

Ladders are used by many types of companies and individuals on a daily basis. High quality ladders can be quite expensive, especially those made of light weight fiberglass or other composite materials. Many people who use ladders, such as tree trimmers, phone company workers, roofers, or painters, have to transport ladders to job sites which may change on a daily basis. Often these people have to transport ladders in a manner such that the ladders are exposed to weather conditions which could be harmful to the ladder.

Many ladders use ropes or pulleys to facilitate the ladder's use. These can also be damaged by exposure to particular weather conditions. To protect the investment in a ladder, one must protect all the ladder's parts from damaging weather conditions, including ice, snow, rain, or sunlight which may lead to deterioration of fiberglass materials. Due to time constraints created either by sudden changes in weather conditions or tight work schedules, a ladder may not be protected properly, or at all.

What is needed is a protective covering for a ladder that can be attached quickly and will protect the ladder from inclement weather conditions or the damaging rays of direct sunlight.

SUMMARY

The ladder jacket of the present invention is a full length protective covering for a ladder. The ladder jacket consists of two portions of a protective material on either side of an elastic portion of material. The ladder jacket is attached to a ladder by a pocket of protective material at the top of the ladder jacket, straps or cords at the bottom of the ladder jacket and a series of straps or cords along the length of the ladder jacket. Because the Ladder Jacket utilizes an elastic portion within the length of the ladder jacket, one ladder jacket can accomodate multiple sizes of ladders. Because the ladder jacket is attached by means of a pocket at the top and straps or cords located at the bottom and at various places along the length of the ladder jacket, the ladder jacket is easily attachable to any size ladder by unrolling the ladder jacket and securing the straps or cords. There is no need to unroll the entire length of the ladder jacket to begin attaching it to a ladder.

DETAILED DESCRIPTION

Figure 1:
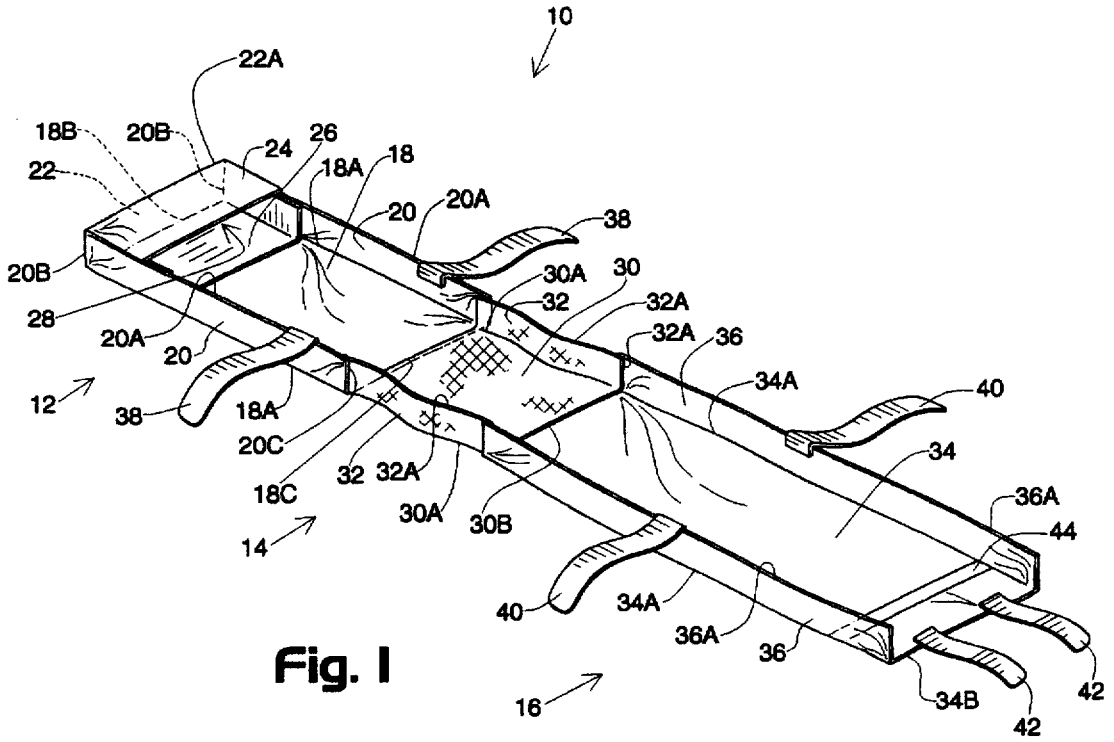
FIG. 1 is a perspective view of the ladder jacket.

FIG. 1 is a perspective view of a ladder jacket 10. The ladder jacket includes a first portion 12, a second portion 14, and a third portion 16.

The first portion 12 includes a substantially rectangular planar member 18. The main member 18 includes two opposing sides 18A, a first end 18B which is disposed opposite a second end 18C. The main member is turned at each of the sides 18A at substantially a right angle to form two planar side members 20. Each side member 20 includes an edge 20A parallel to main member sides 18A, and a first end 20B disposed opposite a second end 20C. The main member 18 is also turned at the first end 18B forming a planar end member 22. The planar end member 22 is attached to the planar side members 20 at ends 20B. The planar end member 22 includes a side 22A positioned parallel to main member end 18B. The planar end member 22 is turned at side 22A at substantially a right angle to form a short planar member 24 substantially parallel to main planar member 18. Short planar member 24 is attached to the planar side members 20 along the edge 20A such that the structure of the main member 18, the side members 20, the end member 22, and the short member 24 forms a pocket 28. The first portion further includes a lining 26 attached to and conforming to the pocket 28.

The second portion 14 includes an elastic main planar member 30 attached to the main member 18 along main member end 18C. The elastic main member 30 includes two opposing sides 30A and an end 30B opposite main member end 18C. The elastic main member 30 is turned at the elastic main member sides 30A at substantially a right angle to form two elastic side members 32. The elastic side members 32 are attached to the side members 20 along end 20C and have an end 32A opposite side member end 20C.

The third portion 16 includes a main planar member 34 attached to the elastic main member 30 along end 30B. The main member 34 includes two opposing sides 34A and an end 34B opposite the elastic main member end 30B. The main member 34 is turned at the sides 34A at substantially a right angle to form two opposing planar sides 36. The planar side members 36 are attached to the elastic side members 32 along the ends 32A. The planar side members 36 have an edge 36A parallel to the main member sides 34A.

Two hook and loop fastening straps 38 are attached opposite each other along edges 20A such that they may be engaged to one another. Two hook and loop fastening straps 40 are attached opposite each other along edges 36A such that they may be engaged to one another.

Two hook and loop fastening straps 42 are attached to edge 34B. A hook and loop fastening strip 44 is attached to the main planar member 36 such that straps 42 may be brought up to engage the hook and loop fastening strip 44.

Figure 2:
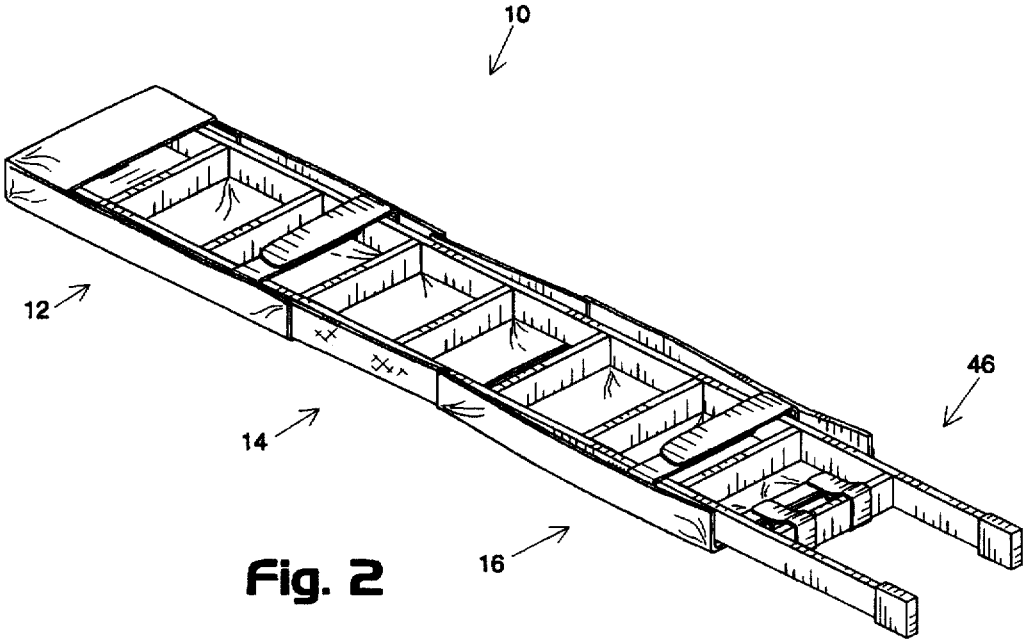
FIG. 2 is a perspective view of the ladder jacket attached to a ladder.

FIG. 2 is a perspective view showing the first portion 12, the second portion 14, and the third portion 16. The ladder jacket 10 is shown attached to a ladder 46.

Thus the ladder jacket of the present invention provides an easily and quickly attached protective covering for a ladder.

While the above description contains many specificities, these should not be construed as limitations on the scope of the invention, but rather as an exemplification of one preferred embodiment. Many variations are possible. For example:

a. the velcro straps may be replaced by cords; and b. additional straps could be attached for longer ladder jackets.

Accordingly, the scope of the invention should be determined not by the embodiment illustrated, but by the appended claims and their legal equivalents.

The invention claimed is:

1. A ladder covering, comprising:

a. an first portion of flexible material having a rectangular end member, a first planar member, two planar sides, a short planar member, and an edge;

b. a second portion having an elastic planar member, two elastic planar sides, a first edge, and a second edge, with the first edge of the second portion attached to the edge of the first portion;

c. a third portion of flexible material having a first planar member, two planar sides, a first edge and a second edge, with the first edge of the third portion attached to the second edge of the second portion;

d. a means for securing the first portion of flexible material attached to the sides of the first portion, and for securing the third portion attached to the sides of the third portion and the second edge of the third portion.

2. A ladder covering of claim 1, further having a liner attached to a pocket formed by the rectangular end member, first planar member, two planar sides, and short planar member of the first portion.

3. A ladder covering of claim 1, wherein the means for securing the first and third portions is a plurality of hook and loop fastening straps.

4. A ladder covering of claim 2, wherein the liner is made of leather.

5. A ladder covering of claim 1, wherein the means for securing the first and third portions is a plurality of cords.

6. A ladder covering of claim 1, wherein the flexible material is opaque plastic.

* * * * *